US006803722B2

(12) United States Patent
Nakamura et al.

(10) Patent No.: US 6,803,722 B2
(45) Date of Patent: Oct. 12, 2004

(54) PLASMA DISPLAY PANEL

(75) Inventors: Tadashi Nakamura, Tokyo (JP); Yoshito Tanaka, Tokyo (JP); Hajime Homma, Tokyo (JP); Kouta Araki, Tokyo (JP); Nobumitsu Aibara, Tokyo (JP); Naoto Hirano, Tokyo (JP); Hiroshi Hasegawa, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/995,383

(22) Filed: Nov. 27, 2001

(65) Prior Publication Data

US 2002/0063524 A1 May 30, 2002

(30) Foreign Application Priority Data

Nov. 28, 2000 (JP) ..... 2000-361698

(51) Int. Cl.[7] ..... H01J 11/02
(52) U.S. Cl. ..... 313/582; 313/584; 313/631
(58) Field of Search ..... 313/581–587, 313/631, 490, 491, 217, 188, 216, 220; 315/169.4; 345/169.4, 585, 587, 581, 631

(56) References Cited

U.S. PATENT DOCUMENTS

| | | | | | |
|---|---|---|---|---|---|
| RE29,629 | E | * | 5/1978 | Ogle | 313/216 |
| 5,640,068 | A | * | 6/1997 | Amemiya | 313/582 |
| 6,037,916 | A | * | 3/2000 | Amemiya | 345/60 |
| 6,157,128 | A | * | 12/2000 | Namiki et al. | 313/581 |
| 6,456,006 | B1 | * | 9/2002 | Torisaki | 313/582 |

FOREIGN PATENT DOCUMENTS

| | | | |
|---|---|---|---|
| JP | 10-302643 | 11/1998 | H01J/11/02 |

* cited by examiner

*Primary Examiner*—Ashok Patel
(74) *Attorney, Agent, or Firm*—Hayes Soloway P.C.

(57) ABSTRACT

A plasma display panel is provided with a transparent substrate, and scanning electrodes and sustaining electrodes formed on the transparent substrate extending in a first direction. An area of the scanning electrode is smaller than an area of the sustaining electrode in each of display cells. The widths of the scanning electrode and the sustaining electrode in a second direction crossing the first direction are substantially equal to each other.

24 Claims, 12 Drawing Sheets

PLASMA DISPLAY PANEL

BACKGROUND OF THE INVENTION

1. Filed of the Invention

The present invention relates to an AC memory type plasma display panel. More specifically it relates to a plasma display panel for stably generating a writing discharge.

2. Description of the Related Art

A plasma display panel generally contains the following characteristics. A plasma display panel has a thin structure. It hardly generates flickers. It provides a high display contrast. It may have a relatively large screen. It provides a high response speed. It is a self-light-emitting type, and may provide multiple color light emission by means of the phosphor. The uses of plasma display panels have been increasing in the fields of large public display apparatuses and color television sets and the like recently.

The operation type of plasma display panel is classified into two categories: AC discharge type (AC type), which has electrodes covered by a dielectric material, and operates in an indirect AC discharge state; and DC discharge type (DC type), which has electrodes exposed to a discharge space, and operates in a DC discharge state. The AC discharge type is further classified into memory operation type, which uses a memory of a discharge cell, and refresh operation type, which does not use a discharge cell. The luminance of a plasma display panel is approximately proportional to the number of discharges, namely, the number of repetitions of a pulse, whether it is the memory operation type or the refresh operation type. Because the refresh type presents a decrease in luminosity as display capacity increases, it is mainly used for small display capacity applications.

FIG. 1 is an exploded oblique perspective view of a display cell constitution in a standard AC discharge memory operation type plasma display panel.

The plasma display panel is provided with front and rear insulation substrates 1 and 2 made of glass. A transparent scanning electrode 3 and a transparent sustaining electrode 4 are formed on the insulation substrate 2 and are placed in parallel with each other. Bus electrodes 5 and 6 are placed so as to overlap the scanning electrode 3 and the sustaining electrode 4 for reducing electrode resistances. Data electrodes 7 crossing the scanning electrode 3 and the sustaining electrode 4 are formed on the insulation substrate 1. A discharge gas space 8 is formed between the insulation substrates 1 and 2 where discharge gas containing helium, neon, xenon or the like, or mixed gas thereof is filled. Phosphor layers 9 are formed to convert ultraviolet ray generated by a discharge of the discharge gas into visible light 14. A dielectric material layer 10 covering the scanning electrode 3 and the sustaining electrode 4 are formed on the insulation substrate 1. A protection layer 11 made of magnesium oxide or the like and protecting the dielectric material layer 10 from the discharge is formed on the dielectric material layer 10. A dielectric material layer 12 covering the data electrode 7 is formed on the insulation substrate 2. Partition walls 13 separating neighboring display cells are formed on the dielectric material layer 12. The surface of data electrode 7 is covered with the dielectric layer 12. The partition wall 13 for separating the display cells is provided between the neighboring data electrodes 7 on the dielectric layer 12. The phosphor layer 9 is applied to the dielectric material layer 12 between the partition walls 13, and on the side faces of partition walls 13. The phosphor layer 9 is painted in three primary colors including red, green and blue, and is arranged to display different colors.

FIG. 2 is a vertical section view showing the display cell in the AC discharge memory operation type plasma display panel shown in FIG. 1.

The following section describes a discharge operation of a selected display cell while referring to FIG. 2.

When a pulse voltage exceeding a discharge threshold is applied between the scanning electrode 3 and the data electrode 7 of individual display cells to start a discharge, negative and positive electric charges are attracted on the surfaces of dielectric material layers 10 and 12 according to the polarity of pulse voltage, thereby generating electric charge accumulations. An equivalent internal voltage caused by these electric charge accumulations, namely, a wall voltage, has a polarity reverse to the pulse voltage. Thus, because an effective voltage in the cell decreases as the discharge grows, maintaining the pulse voltage to a constant value does not keep the discharge, and the discharge finally stops.

When a discharge starts between the scanning electrode 3 and the data electrode 7, this discharge triggers a discharge between the scanning electrode 3 and the sustaining electrode 4 if a voltage more than a certain level is applied between the scanning electrode 3 and the sustaining electrode 4. As the result, electric charge accumulations are generated in the dielectric layer 10 so as to cancel the voltage applied at this moment as the discharge between the scanning electrode 3 and the data electrode 7.

Then, a sustaining discharge pulse, which has a pulse voltage with a polarity same as the wall voltage, is applied between the scanning electrode 3 and the sustaining electrode 4, a voltage corresponding to the wall voltage is superimposed as an effective voltage, and the discharge occurs exceeding the discharge threshold when a voltage amplitude of the sustaining discharge pulse is low. Thus, keeping the sustaining discharge pulse applied alternately between the scanning electrode 3 and the sustaining electrode 4 maintains the discharge. This function is the memory function described before.

FIG. 3 is a block diagram showing a constitution of a display apparatus using a plasma display panel where the display cells shown in FIG. 2 are formed as a matrix arrangement.

A plasma display panel 15 is a panel for dot matrix display where the display cells 16 are arranged as m×n of rows and columns. As row electrodes, scanning electrodes X1, X2, . . . , Xm and sustaining electrodes Y1, Y2, . . . , Ym are provided in parallel with one another. As column electrodes, data electrodes D1, D2, . . . , Dn are arranged in crossing the scanning electrodes and the sustaining electrodes.

A scanning driver 17 applies a scanning electrode drive wave on the scanning electrodes X1, X2, . . . , Xm. A sustaining driver 18 applies a sustaining electrode drive wave on the sustaining electrodes Y1, Y2, . . . , Ym. A data driver 19 applies a data electrode drive wave on the data electrodes D1, D2, . . . , Dn.

A control circuit 20 generates control signals for the individual drivers based on base signals (Vsync, Hsync, Clock, and DATA). The control circuit 20 is provided with a signal processing and memory controller 20*a* for generating control signals for a frame memory and a driver-controller from the base signals, a frame memory 20*b* for storing the DATA signal, which is image data, and a driver-controller 20*c* for generating the control signals for the individual electrode drivers.

FIG. 4 is a timing chart showing driving signal waveforms provided from the scanning driver 17, the sustaining driver 18, and the data driver 19.

Wu indicates a sustaining electrode driving pulse applied commonly on the sustaining electrodes Y, Y2, . . . , Ym, Ws1, Ws2, . . . , Ws3 indicate scanning electrode driving pulses applied respectively on the scanning electrodes X1, X2, . . . , Xm, and Wd indicates a data electrode driving pulse applied on a data electrode Di ($1 \leqq i \leqq n$) in FIG. 4.

One cycle of the driving (1 Sub-Field: SF) is composed of a preliminary discharge period, a writing discharge period, a sustaining discharge period, and an erasing discharge period, and repeating them provides a desired video image display.

The preliminary discharge period is a period for generating active particles in the discharge gas space 8, and wall electric charges to obtain a stable writing discharge characteristic in the writing discharge period. After a pre-discharge pulse Pp is applied for simultaneously discharging all display cells on the plasma display panel 15, a preliminary discharge erasing pulse Ppe is simultaneously applied on the individual scanning electrodes for removing electric charge that inhibits the writing discharge and the sustaining discharge from the generated wall electric charges, in the preliminary discharge period. Namely, after the preliminary discharge pulse Pp is applied on the scanning electrodes X1, X2, . . . , Xm to start the discharge all the display cells, the sustaining electrodes Y1, Y2, . . . , Ym are brought up to a sustaining voltage level Vs. Then, the preliminary discharge erasing pulse Ppe is applied on the scanning electrodes X1, X2, . . . , Xm to generate an erasing discharge, thereby gradually decrease their voltages, resulting in erasing the wall electric charges accumulated by the preliminary discharge pulse. The erasing here includes adjusting the amount of wall electric charges for smoothly conducting the following writing discharge and sustaining discharge in addition to removing the wall electric charge entirely.

A scanning pulse Pw is sequentially applied on the individual scanning electrodes X1, X2, . . . , Xm, and a data pulse Pd is selectively applied on the data electrodes Di ($1 \leqq i \leqq n$) in the display cells that display in synchronous with the scanning pulse Pw in the writing discharge period. As the result, the writing discharge is generated in the cells that display to generate wall electric charge.

A sustaining discharge pulse Pc is applied on the sustaining electrodes, and a sustaining discharge pulse Ps whose phase is delayed by 180 degree than the sustaining discharge pulse Pc is applied on the individual scanning electrodes in the sustaining discharge period. Necessary sustaining discharge is repeated to obtain required luminance on the display cells where the writing discharges are conducted during the writing discharge period.

Finally, an erasing pulse Pe is applied on the scanning electrodes X1, X2, . . . , Xm to gradually decrease their voltages, thereby generating an erasing discharge, resulting in removing the wall electric charges accumulated by the sustaining discharge pulses in the erasing discharge period. The erasing here includes adjusting the amount of wall electric charge for smoothly conducting the following preliminary discharge, writing discharge and sustaining discharge in addition to removing the wall electric charges entirely.

It is desirable that a matrix discharge tends to start between the scanning electrode and the data electrode during the writing discharge, and this matrix discharge quickly triggers a surface discharge between the scanning electrode and the sustaining electrode in this driving method. This is because that conducting these discharges stably means displaying an input image precisely.

Publication of unexamined patent application No. Hei 10-302643 discloses a method for decreasing the width of a scanning electrode than that of a sustaining electrode for stabilizing the writing discharge.

FIG. 5 is a vertical section view showing a structure of a display cell disclosed in publication of unexamined patent application H10-302643. This prior art decreases the width of scanning electrode 3 in the standard display cell structure shown in FIG. 1, namely, the length of electrode in the horizontal direction than that of the sustaining electrode 4 in FIG. 5. In this case, because the area where the scanning electrode 3 faces the data electrode 7 decreases, the transition to the surface discharge tends to occur.

An extension of the sustaining discharge in the individual display cells on the AC type plasma display panel depends on an area where the scanning electrode and the sustaining electrode are formed, and the sustaining discharge area becomes wider as this area becomes wider. As the sustaining discharge area increases, the amount and the area of ultraviolet ray increase in the display cell, thereby increasing stimulating quantity to the phosphor, resulting in increasing the luminance.

This means that as the screen size of a plasma display panel increases, and the size of individual display cells increases, the electrode area naturally increases, thereby providing a bright image. On the other hand, the matrix discharge area during the writing discharge increases, the transition characteristic to the surface discharge decreases, thereby preventing a stable image display.

FIG. 6 is a schematic view showing a state of the writing discharge of the plasma display panel shown in FIG. 2. Here, only the matrix discharge is shown, and the surface discharge that triggered it is suppressed.

As shown in FIG. 6, when the area of scanning electrode 3 is large, and an overlap with the data electrode 7 is large, an area where a matrix discharge starts varies. In this state, though if a matrix discharge is generated in an area close to the sustaining electrode 4, it easily changes to a surface discharge, if a matrix discharge is generated in an area far from the sustaining electrode 4, it hardly changes to a surface discharge. It is required to applying a higher voltage between the data electrode 7 and the scanning electrode 3 to strengthen the matrix discharge, and to increasing the voltage applied between the sustaining electrode 4 and the scanning electrode 3 during the writing discharge, in order to properly generate the surface discharge in any states of the matrix discharge.

When the applied voltage increases, a driver with a higher withstand voltage is required, and the power consumption increases. Also, the extensions of individual matrix discharge areas become relatively wide, thereby increasing matrix discharge current, resulting in requiring application of the scanning driver and the data driver with higher output current capability.

On the other hand, because the conventional plasma display panel shown in FIG. 5 has the scanning electrode 3 with the narrower width, though the variation of area where the matrix discharge occurs decreases, and the transition characteristic from the matrix discharge to the surface discharge becomes smooth, the extension of sustaining discharge becomes smaller.

FIGS. 7A and 7B are schematic views showing a state of a sustaining discharge of the plasma display panel shown in FIG. 5. FIG. 7A shows a discharge state where the sustaining electrode 4 is set to an electric potential of 0 V, and the scanning electrode 3 is set to an electric potential of Vs, and FIG. 7B shows a discharge state where the sustaining electrode 4 is set to an electric potential of Vs, and the scanning electrode 3 is set to an electric potential of 0 V. The respective wall electric charges are those accumulated after the sustaining discharge occurs.

The extension of a sustaining discharge follows areas where the sustaining electrode 4 and the scanning electrode 3 are provided, and reaches to mutually further ends of the sustaining electrode 4 and the scanning electrode as shown in FIG. 7A and FIG. 7B. Because ultraviolet ray generated by this discharge is projected isotropically, it stimulates areas of the phosphor that do not oppose to the electrode, and is converted into visible light. Namely, the visible light is observed on the outside of scanning electrode (further side from the sustaining electrode). The amount of ultraviolet ray reaching to these areas is smaller than that in the area where the scanning electrode exists because the distance between the discharging area and the phosphor is large, thereby decreasing the converted amount to the visible light, resulting in emitting dark light.

SUMMARY OF THE INVENTION

It is an object of the present invention is to provide a plasma display panel with high luminance while stabilizing a writing discharge.

A plasma display panel according to the present invention comprises a transparent substrate, and scanning electrodes and sustaining electrodes formed on the transparent substrate, constituting surface discharge electrodes, and extending in a first direction. An area of the scanning electrode is smaller than an area of the sustaining electrode in each of display cells. The widths of the scanning electrode and the sustaining electrode in a second direction crossing the first direction are substantially equal to each other.

According to the present invention, it is possible to reduce an matrix discharge current during a writing discharge, to increase a transition characteristic from an matrix discharge to a surface discharge, and to increase the luminance. If the scanning electrode and the sustaining electrode are isolated in the display cells, it is possible to increase luminous efficiency, and to reduce charging/discharging power as well.

DETAILED DESCRIPTION OF THE PREFERRED EMBODIMENTS

The following section specifically describes preferred embodiments of the present invention while referring to accompanied figures.

Figure 1:
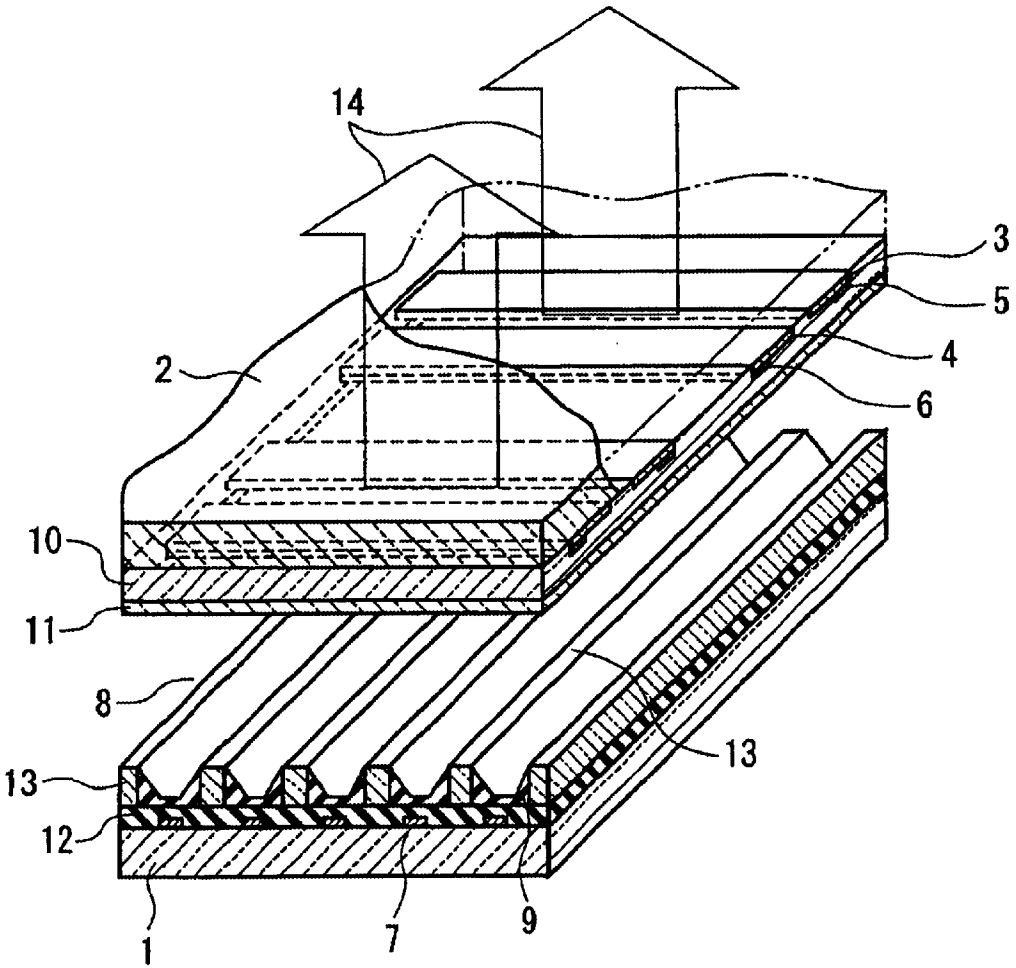
FIG. 1 (PRIOR ART)
FIG. 1 is an exploded oblique perspective view showing a display cell constitution in a standard AC discharge memory operation type plasma display panel.
Figure 8:
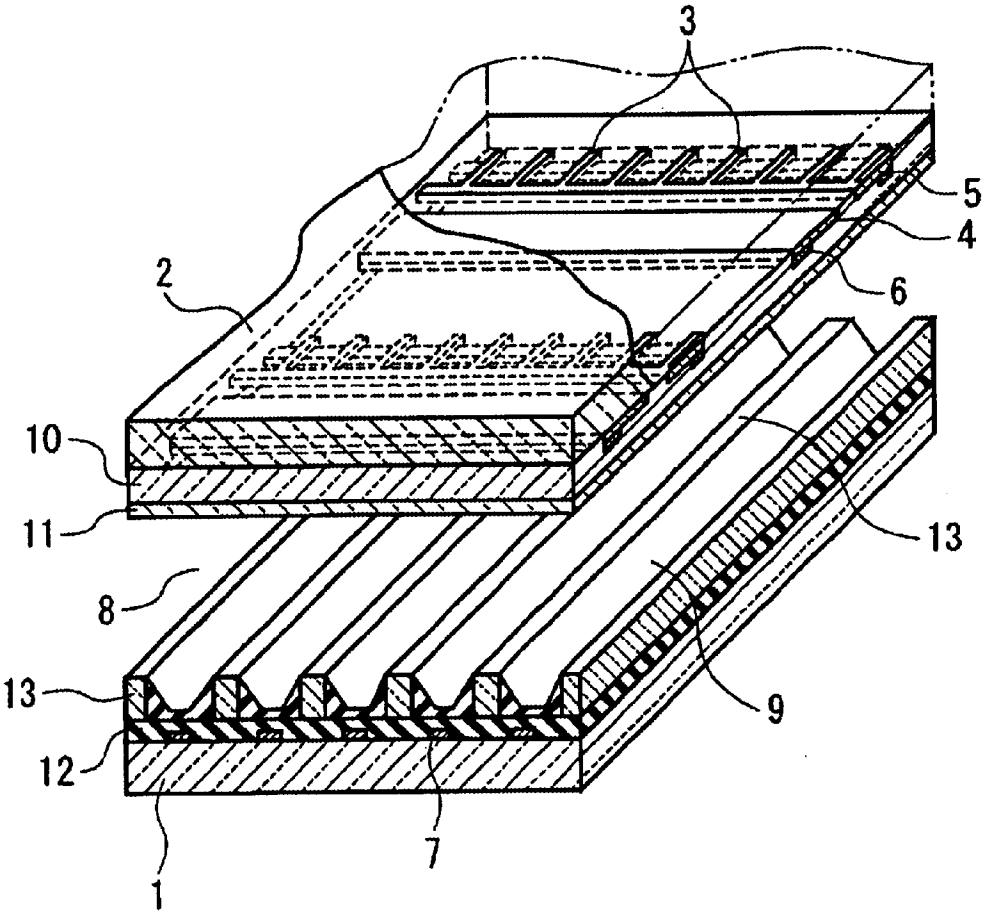
FIG. 8 is an exploded oblique perspective view showing a plasma display panel according to a first embodiment of the present invention.
Figure 9:
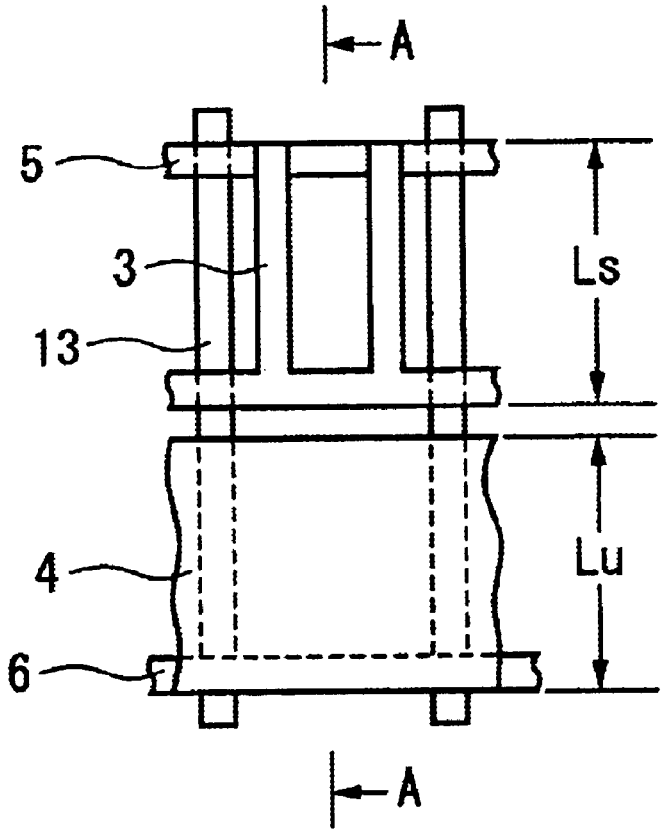
FIG. 9 is a top view showing one display cell viewed from a display face side of the plasma display panel shown in FIG. 8.

FIG. 8 is an exploded oblique perspective view showing a plasma display panel according to a first embodiment of the present invention. FIG. 9 is a top view showing one display cell viewed from a display face side of the plasma display panel shown in FIG. 8 while putting an emphasis on the scanning electrode, the sustaining electrode, and the partition wall. The same reference numerals are provided, and detailed descriptions are suppressed for constituting elements of the first embodiment shown in FIG. 8 and FIG. 9 that are the identical to those of the conventional plasma display panel shown in FIG. 1.

While the sustaining electrode 4 has the same shape as that of the conventional art, the scanning electrode 3 across the display cell in the horizontal direction has a narrower width in the present embodiment. This decreases parts connecting the scanning electrode 3 with a bus electrode 6. The scanning electrode 3 is connected with the bus electrode 5 with two lines in the individual display cells as shown in FIG. 9. It has a shape where center parts of the partition wall and the discharge cell space are removed compared with the conventional art. The length Ls of scanning electrode 3 including the bus electrode 5 in the vertical direction, and the length Lu of sustaining electrode 4 in the vertical direction are equal to each other, for example.

Figure 4:
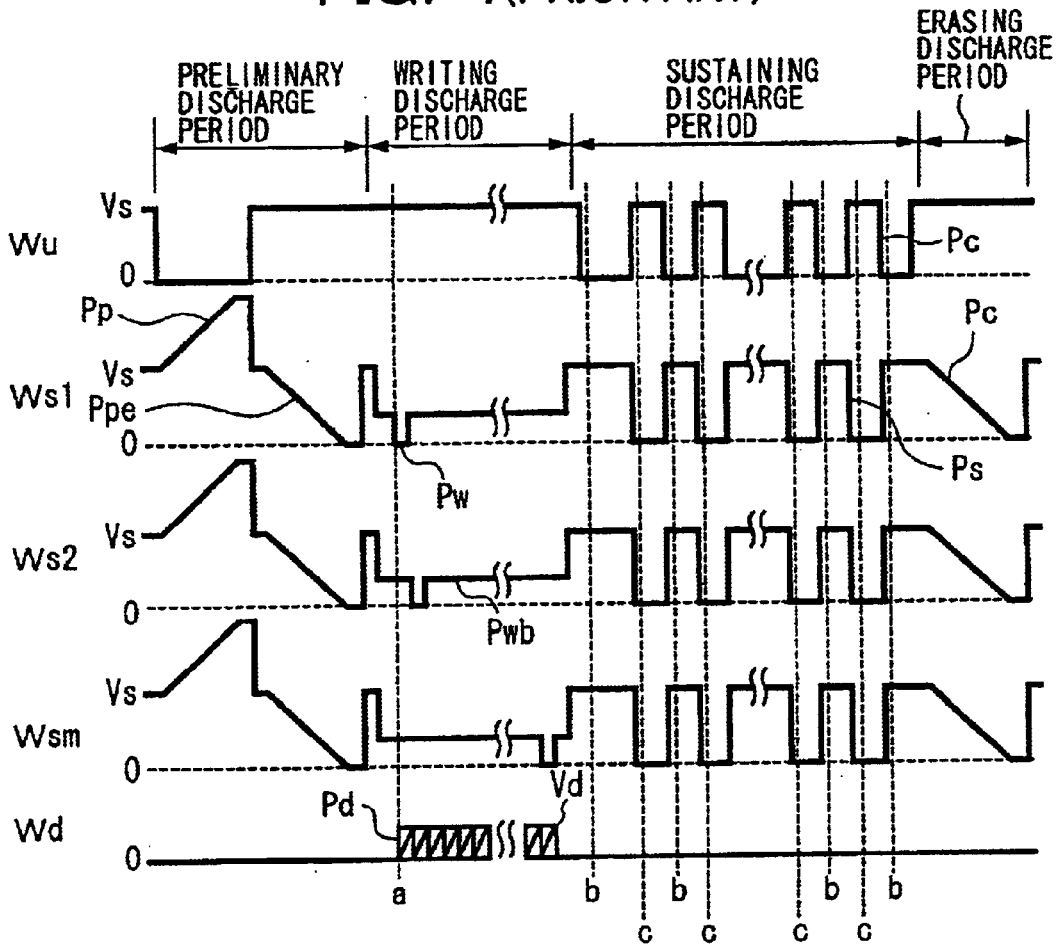
FIG. 4(PRIOR ART)
FIG. 4 is a timing chart showing driving signal waveforms provided from the scanning driver 17, the sustaining driver 18, and the data driver 19.
Figure 5:
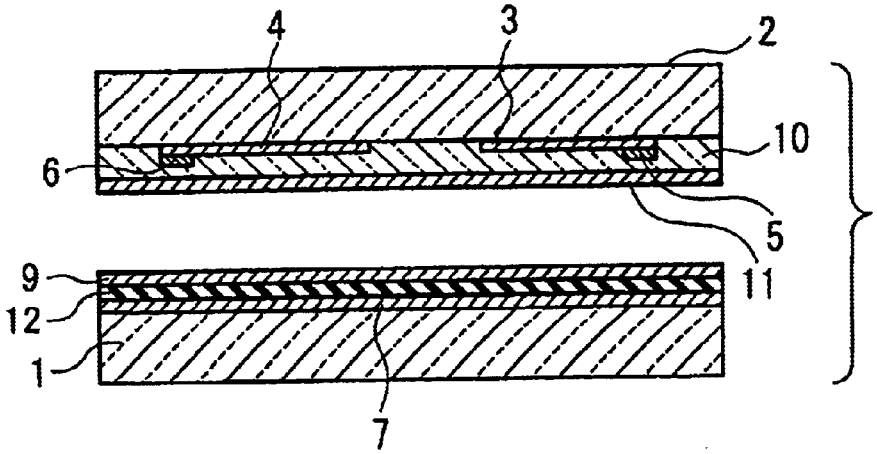
FIG. 5(PRIOR ART)
FIG. 5 is a vertical section view showing a structure of a display cell disclosed in publication of unexamined patent application H10-302643.
Figure 6:
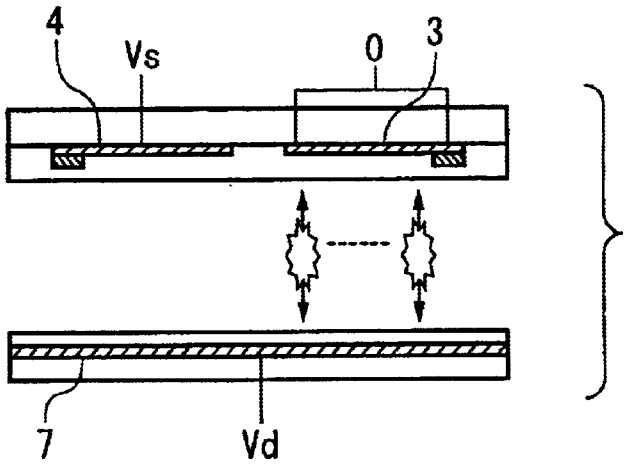
FIG. 6(PRIOR ART)
FIG. 6 is a schematic view showing a state of the writing discharge of the plasma display panel shown in FIG. 2.
Figure 7A:
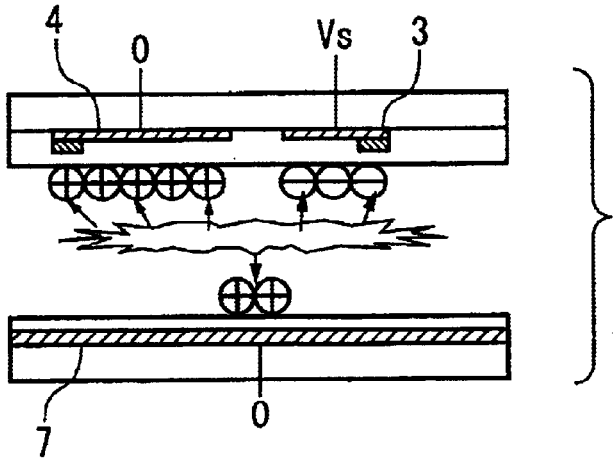
FIG. 7A (PRIOR ART)
FIGS. 7A and 7B are schematic views showing a state of a sustaining discharge of the plasma display panel shown in FIG. 5.
Figure 7B:
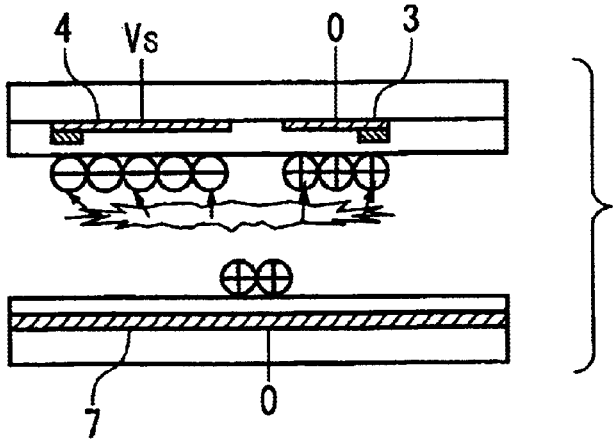
FIG. 7B (PRIOR ART)
Figure 10A:
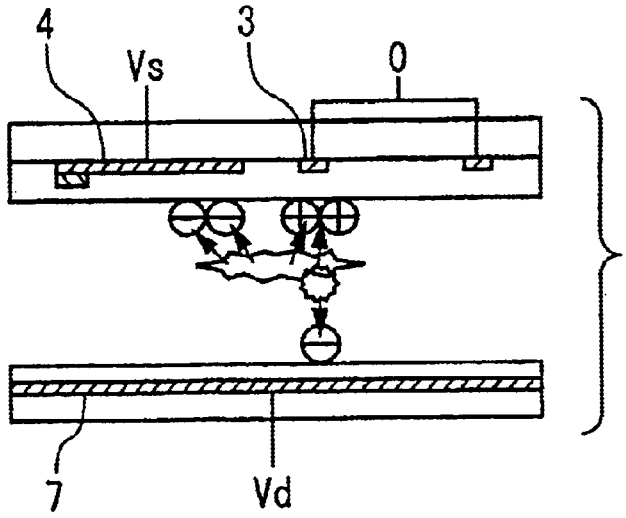
FIGS. 10A to 10C are schematic views showing a writing discharge, a sustaining discharge, and a change of wall electric charge on a section along a line A—A in FIG. 9.
Figure 10B:
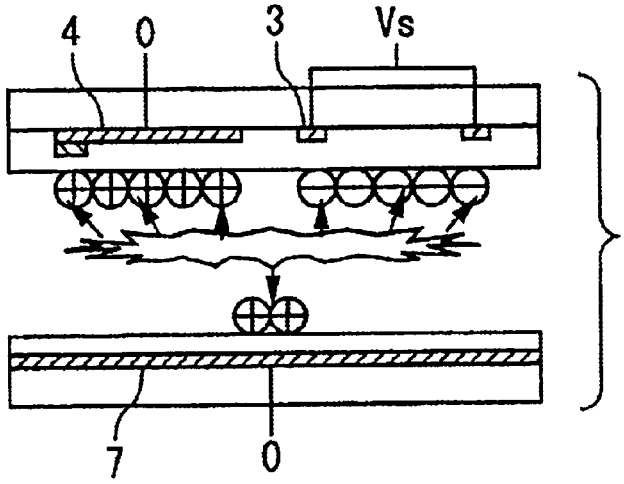
Figure 10C:
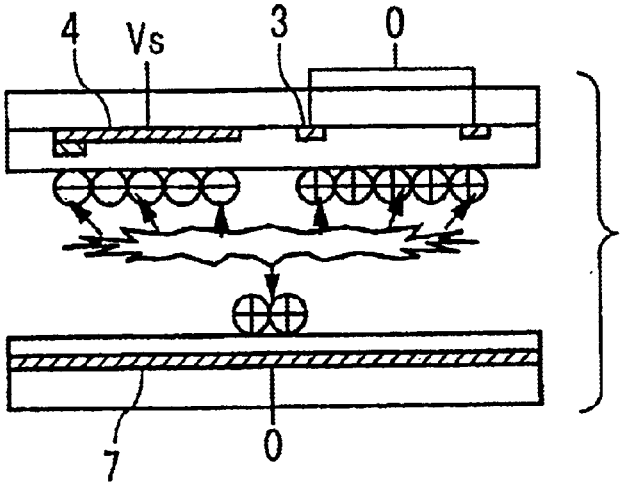

FIGS. 10A to 10C are schematic views showing a writing discharge, a sustaining discharge, and a change of wall electric charge on a section along a line A—A in FIG. 9. FIG. 10A shows a state of the discharge and the wall electric charges during the writing discharge. FIG. 10B and FIG. 10C show states of the discharge and the wall electric charges during the sustaining discharge. FIG. 10A to FIG. 10C correspond to the timing a to c in FIG. 4 respectively. The wall electric charges shown here indicate states after a discharge starts at the individual timing.

A scanning pulse is applied on the scanning electrode 3 to set it to an electric potential of 0 V, and a data pulse is applied on a data electrode 7 to set it to an electric potential of Vd at the timing a as shown in FIG. 10A. A threshold of the discharge is exceeded, and an matrix discharge is generated between the scanning electrode 3 and the data electrode 7. At this time, the sustaining electrode 4 is set to an electric potential of Vs, which is a sustaining voltage level, a surface discharge between the scanning electrode 3 and the sustaining electrode 4 starts triggered by the matrix discharge. The relationship of electric potential among these electrodes, a positive electric charge is accumulated as a wall electric charge at the scanning electrode part, and negative electric charges are accumulated as a wall electric charge at the data electrode part and the sustaining electrode part.

Because an overlapping area between the scanning electrode and the data electrode is smaller in the structure of this plasma display panel, a matrix discharge current is smaller during a writing discharge than that of the conventional art.

Further, because the area of scanning electrode part close to the sustaining electrode is small, the electric field is concentrated in this neighborhood, the discharge between the scanning electrode and the data electrode tends to occur at a position close to the sustaining electrode. As the position of matrix discharge comes close to the sustaining electrode, the surface discharge between the sustaining electrode and the scanning electrode triggered by this tends to start. This is because a high density area of active particles such as a space charge generated by the matrix discharge comes close to an area where the surface discharge starts.

After the writing discharge is conducted in the display cell, it moves to the sustaining discharge period. The data electrode 7 falls down to an electric potential of 0 V, the scanning electrode 3 rises up to an electric potential of Vs, and the sustaining electrode 4 falls down to an electric potential of 0 V at the timing b in the sustaining discharge period as shown in FIG. 10B. As the result, a voltage that is a potential difference Vs applied between the sustaining electrode 4 and the scanning electrode 3 superimposed with the wall electric charges generated by the writing discharge is applied on the discharge cell space, and an discharge threshold is exceeded to start a surface discharge. Once the discharge starts, a negative electric charge is accumulated at the scanning electrode part, and positive electric charges are accumulated at the sustaining electrode part and the data electrode part so as to cancel the voltages applied on the individual electrodes, resulting in stopping the discharge.

Then, the scanning electrode 3 falls down to an electric potential of 0 V, and the sustaining electrode 4 rises up to an electrical potential of Vs at the timing c as indicated in FIG. 10C. As the result, a voltage that is superimposed with the wall electric charges generated during the sustaining discharge is applied on the discharge cell space, and the discharge threshold is exceeded to start a surface discharge. Once the discharge starts, a negative electric charge is accumulated at the sustaining electrode part, and positive electric charges are accumulated at the scanning electrode part and the data electrode part so as to cancel the voltages applied on the individual electrodes, resulting in stopping the discharge.

These sustaining discharge occurs in an extent from the bus electrode 5 of scanning electrode 3 to the bus electrode 6 of sustaining electrode 4 as indicated in FIG. 10B and FIG. 10C. Because the wall electric charges on the sustaining electrode part and the scanning electrode part are adjusted so as not to start a surface discharge even though the voltage Vs is applied during the writing discharge, the surface discharge triggered by the matrix discharge is relatively weak. On the other hand, because the sustaining discharge is caused by the voltage Vs superimposed with the wall electric charge, it is stronger than the surface discharge during the writing discharge. Thus, the discharge extends to the bus electrode of scanning electrode, which is at a place distant from the sustaining electrode 4.

The quantity of visible light generated when ultraviolet ray generated by the discharge stimulates the phosphor depends on the source discharge intensity and the extent of discharge. Namely, as the discharge intensity and the extent of discharge increase, the amount of visible light increases, and the display becomes brighter. Further, while the area of scanning electrode is small, the area of sustaining electrode is equivalent to that in the conventional art in the structure of plasma display panel relating to the present embodiment. Though when the electrode area for generating the discharge decreases, the sustaining electrode current decreases as well, because the sustaining electrode area is large, and the length in the vertical direction of scanning electrode is equivalent to that of the sustaining electrode, the sustaining discharge current retains in a relatively large state in the present embodiment. As the sustaining discharge current increases, the ultraviolet dose generated by the discharge increases as well, and the light emission becomes brighter.

Further, because the length of scanning electrode close to and in parallel with the sustaining electrode, namely horizontal direction length, is large, the sustaining discharge area in the horizontal direction extends across an entire area in the horizontal direction of display cell, and the discharge area in the horizontal direction does not decrease compared with the conventional art.

Figure 11:
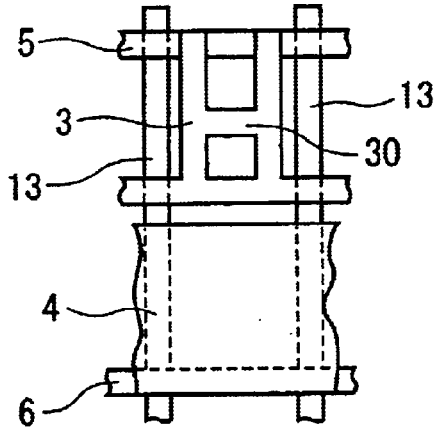
FIG. 11 is a top view showing a structure of a plasma display panel according to the second embodiment of present invention.

The following section describes a plasma display panel according to a second embodiment of the present invention. FIG. 11 is a top view showing a structure of a plasma display panel according to the second embodiment of present invention. The same reference numerals are provided, and detailed descriptions are suppressed for constituting elements of the second embodiment shown in FIG. 11 that are the identical to those of the first embodiment shown in FIG. 9 and the like.

An electrode 30, which connects the left with the right in a ladder-shape is formed in a center part of the scanning electrode 3 in the second embodiment.

Though a sustaining discharge extends to the bus electrode of the scanning electrode in a relatively small display cell, the discharge may not extend to the bus electrode in some cases as the size of display cell increases in the first embodiment.

Generally, as a distance between electrodes increases, the discharge threshold increases excepting ceases where a product of a sealed gas pressure and the distance between the electrodes is exceptionally small, and it becomes necessary to apply a higher voltage to generate a discharge. The phenomenon described above occurs because as the display cell increases and the removed part in the scanning electrode increases, the distance from the sustaining electrode to the bus electrode of scanning electrode increases, it becomes required to apply a higher sustaining voltage to extend the sustaining discharge to the bus electrode of scanning electrode.

Because the intermediate ladder-shape electrode is provided between the scanning electrode close to the sustaining electrode and the bus electrode, the sustaining discharge extends to the ladder-shape electrode first, then this triggers an immediate extension of the sustaining discharge to the bus electrode in the second embodiment. Thus, a decrease of the matrix discharge current during the writing discharge and the increase of transition characteristic from the matrix discharge to the surface discharge shown in the first embodiment are attained while a large area where the sustaining discharge starts is maintained if the display cell size increases.

Figure 12:
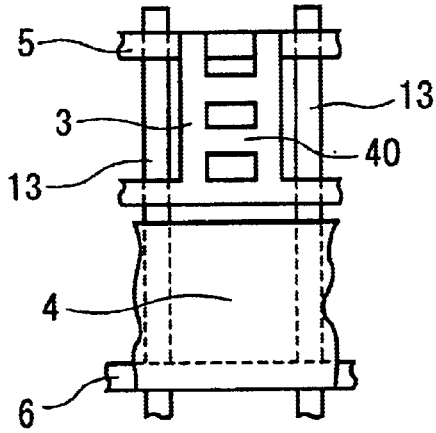
FIG. 12 is a top view showing a structure of a plasma display panel according to another example of the second embodiment of present invention.

It is desirable to provide multiple intermediate ladder-shape electrodes 40 between the scanning electrode 3 close to the sustaining electrode 4 and the bus electrode 5 for further restraining the increase of sustaining voltage, as shown in FIG. 12. The same reference numerals are provided, and detailed descriptions are suppressed for constituting elements in FIG. 12 that are the identical to those of the embodiment shown in FIG. 11.

Though second embodiment shown in FIG. 11 and FIG. 12 has one or two of the ladder-shape electrodes, the number of ladder-shape electrodes is not limited to them, and a proper number should be selected according to the size of a display cell and the like.

Figure 13:
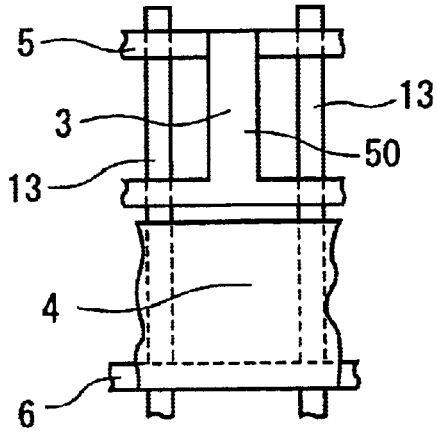
FIG. 13 is a top view showing a structure of a plasma display panel according to the third embodiment of present invention.

The following section describes a plasma display panel according to a third embodiment of the present invention. FIG. 13 is a top view showing a structure of a plasma display panel according to the third embodiment of present invention. The same reference numerals are provided, and detailed descriptions are suppressed for constituting elements of the third embodiment shown in FIG. 13 that are the identical to those of the first embodiment shown in FIG. 9 and the like.

One narrow electrode 50 connecting the scanning electrode 3 with the bus electrode 5 is formed at the center of display cell in the third embodiment.

Because the data electrode 7 is provided immediately below the electrode 50 connecting the scanning electrode 3 with the bus electrode 5, the area in which the scanning electrode 3 and the data electrode 7 overlap each other is the same as that in the conventional art when seen from the display surface in the vertical direction in the third embodiment constituted in this way. The matrix discharge does not always occurs in the vertical direction of display surface, but they may occur in oblique paths. When once a discharge starts in any path, in an area facing the discharge cell space, especially in an area where the part where the discharge starts continues to the electrode, a discharge starts as a chain reaction, and the discharge area extends. Thus, because the scanning electrode has a shape where the both sides are removed while leaving an electrode at the center part, the matrix discharge area is reduced during the writing discharge, and an effect of reducing the discharge current is attained as in the first and second embodiments in the third embodiment.

Because the area of a part of the scanning electrode close to the sustaining electrode 4 is narrow, the electric filed is concentrated in this neighborhood, and a discharge between the scanning electrode and the data electrode tends to start at a position close to the sustaining electrode, thereby increasing the transition characteristic to the surface discharge as in the first and second embodiments.

Further, the discharge area extends from the bus electrode 6 of sustaining electrode 4 to the bus electrode 5 of scanning electrode 3, and the sustaining electrode area is maintained wide during the sustaining discharge as in the first embodiment. This increases the sustaining discharge current, and a bright light emission is obtained.

Figure 14:
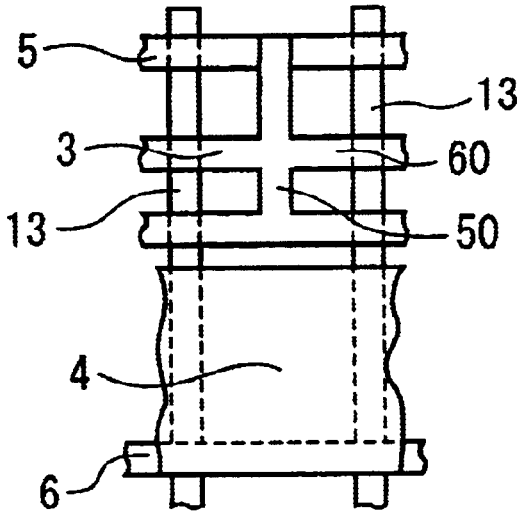
FIG. 14 is a top view showing a structure of a plasma display panel according to the fourth embodiment of present invention.

The following section describes a plasma display panel according to a fourth embodiment of the present invention. FIG. 14 is a top view showing a structure of a plasma display panel according to the fourth embodiment of present invention. The same reference numerals are provided, and detailed descriptions are suppressed for constituting elements of the fourth embodiment shown in FIG. 14 that are the identical to those of the third embodiment shown in FIG. 13.

In the fourth embodiment, an electrode 60 is added in parallel with the sustaining electrode 4 in a center part of the scanning electrode of third embodiment. While the ladder-shape electrode 30 is added to the first embodiment in the second embodiment, the electrode 60 in parallel with the sustaining electrode operates as the ladder-shape electrode 30. Thus, when the display cell size increases, reducing the matrix discharge current during the writing discharge and increasing the transition characteristic from the matrix discharge to the surface discharge shown in the third embodiment are attained while area where the sustaining discharge starts are maintained as large.

Figure 15:
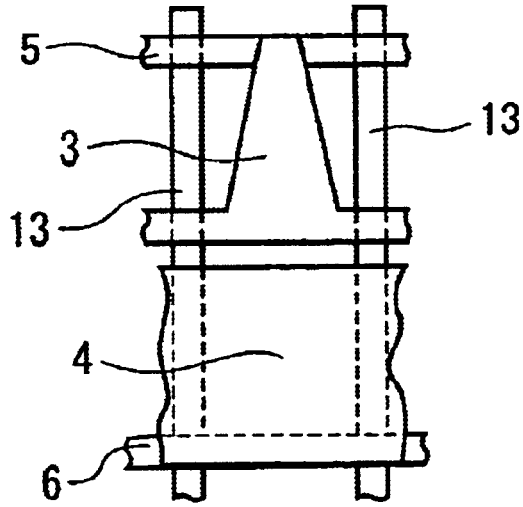
FIG. 15 is a top view showing a structure of a plasma display panel according to the fifth embodiment of present invention.

The following section describes a plasma display panel according to a fifth embodiment of the present invention. FIG. 15 is a top view showing a structure of a plasma display panel according to the fifth embodiment of present invention. The same reference numerals are provided, and detailed descriptions are suppressed for constituting elements of the fifth embodiment shown in FIG. 15 that are the identical to those of the third embodiment shown in FIG. 13.

The width of a part connecting a part of the scanning electrode 3 close to the sustaining electrode 4 and the bus electrode 5 decreases as it gets close to the bus electrode 5 in the fifth embodiment.

The sustaining discharge area tends to extend to the bus electrode 5 of scanning electrode 3 in the fifth embodiment constituted in this way. Because the electrode width on the side close to the sustaining electrode 4 is widened, a discharge toward the bus electrode 6 is wider, and the discharge intensity is stronger at the beginning of sustaining discharge.

Figure 2:
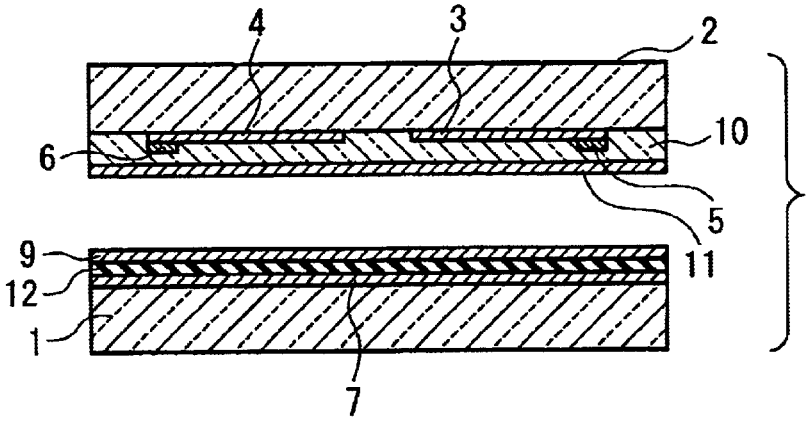
FIG. 2(PRIOR ART)
FIG. 2 is a vertical section view showing the display cell in the AC discharge memory operation type plasma display panel shown in FIG. 1.
Figure 3:
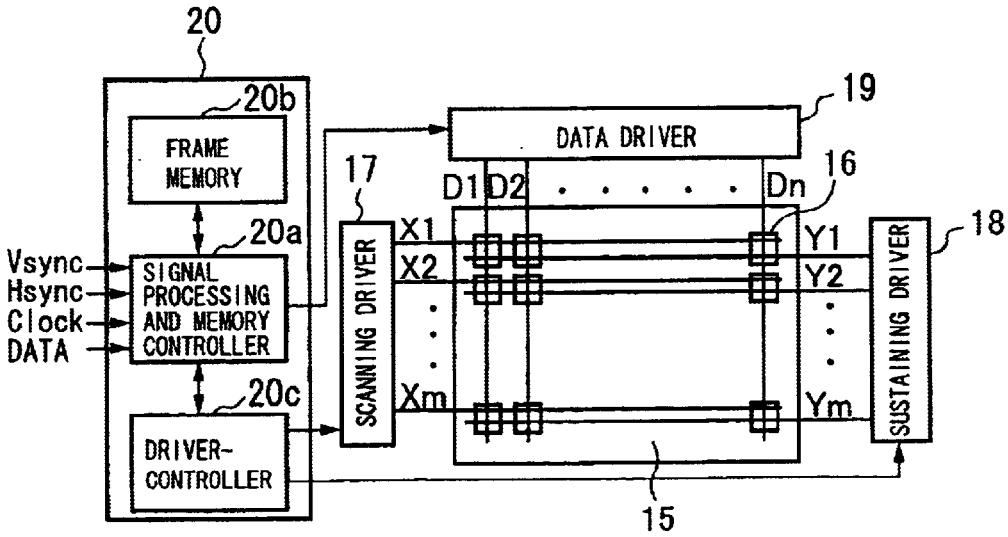
FIG. 3(PRIOR ART)
FIG. 3 is a block diagram showing a constitution of a display apparatus using a plasma display panel where the display cells shown in FIG. 2 are formed as a matrix arrangement.

While the matrix discharge current increases slightly because the matrix discharge area during the writing discharge increases slightly compared with the fourth embodiment, the characteristic of sustaining discharge increases as described above. The width of two electrodes for connecting the scanning electrode part close to the sustaining electrode 4 with the bus electrode 5 may decrease as they get close to the bus electrode for the shapes of electrodes shown in FIG. 2 in the same way.

The number of electrodes for connecting the scanning electrode part close to the sustaining electrode 4 with the bus electrode 5 is not limited.

Figure 16:
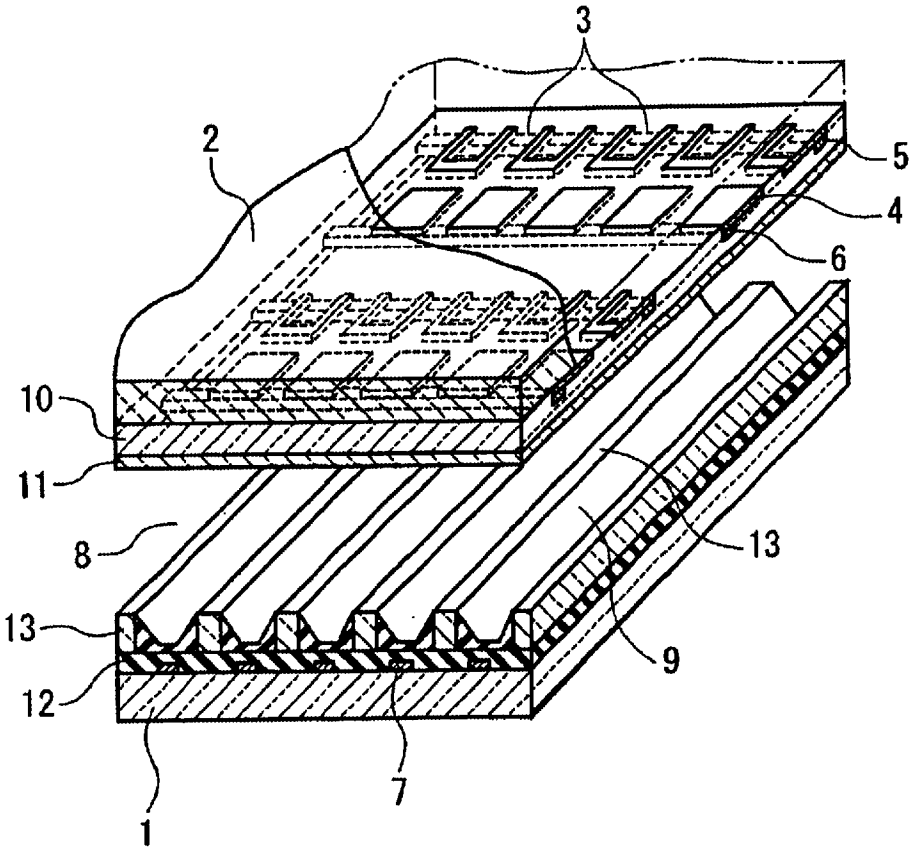
FIG. 16 is a top view showing a structure of a plasma display panel according to the sixth embodiment of present invention.
Figure 17:
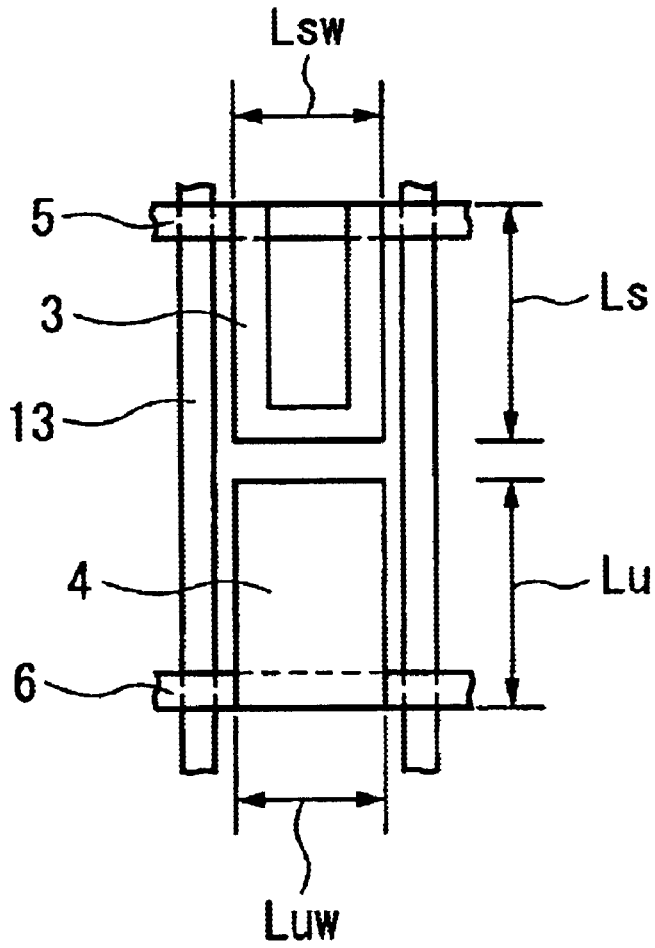
FIG. 17 is a top view showing one display cell viewed from a display face side of the plasma display panel shown in FIG. 16.

The following section describes a plasma display panel according to a sixth embodiment of the present invention. FIG. 16 is a top view showing a structure of a plasma display panel according to the sixth embodiment of present invention. FIG. 17 is a top view showing one display cell viewed from a display face side of the plasma display panel shown in FIG. 16 while putting an emphasis on the scanning electrode, the sustaining electrode, and the partition wall. The same reference numerals are provided, and detailed descriptions are suppressed for constituting elements of the sixth embodiment shown in FIG. 16 and FIG. 17 that are the identical to those of the first embodiment shown in FIG. 8 and FIG. 9.

The sustaining electrode and the scanning electrode are isolated in the individual display cells in the present embodiment. Only the bus electrode is provided for the multiple display cells in the horizontal direction. The scanning electrode and the sustaining electrode are in an area facing the discharge cell space in the individual display cells. Namely, there is no scanning electrode or sustaining electrode in a part overlapping the partition wall. Further, the horizontal length of scanning electrode Lsw and the horizontal length of sustaining electrode Luw are equivalent to each other, for example. Also, the vertical length of scanning electrode Ls and the vertical length of sustaining electrode Lu are equivalent to each other, for example.

With this sixth embodiment, because the scanning electrode and the sustaining electrode are isolated in the individual display cells, efficiency for converting discharge power into visible light, namely, luminous efficiency, increases.

Once a discharge starts, large number of electric charges such as ions and electrons caused by ionization of sealed gas, and excited atoms and molecules are generated in general. These active space particles recombine to decrease their number as time elapses in a natural state, and the number decrease remarkably in a neighborhood of the partition wall. Thus, the rate of ultraviolet ray generated by the discharge decreases in this area. This means the luminous efficiency is low in the area close to the partition wall.

On the other hand, because the horizontal lengths of scanning electrode and sustaining electrode are shorter than the horizontal length of discharge cell space in the present embodiment, the horizontal length of discharge area is decreased, and the discharge in areas close to the partition walls where the luminous efficiency is low is restrained. With this, the total luminous efficiency increases. Also, even when the Lsw and Luw are equal to the horizontal length of discharge cell space, electrostatic capacity between the scanning electrode and the sustaining electrode decreases. Thus, charge/discharge power generated when a voltage is applied to this electrostatic capacity for the sustaining discharge and the like may decrease.

A center part of the scanning electrode 3 is removed in the present embodiment. Adopting this shape reduces the matrix discharge current during the writing discharge, increases the transition characteristic to the surface discharge, and increases the luminance as in the first embodiment.

FIG. 18A to FIG. 18E are top views showing the structures of plasma display panels according to a seventh embodiment to an eleventh embodiment of the present invention respectively.

The horizontal lengths Lsw and Luw of scanning electrodes and sustaining electrodes are equal to each other, and the vertical lengths Ls and Lu are equal to each other as in the sixth embodiment.

Figures 18A, 18B, 18C, 18D, 18E:
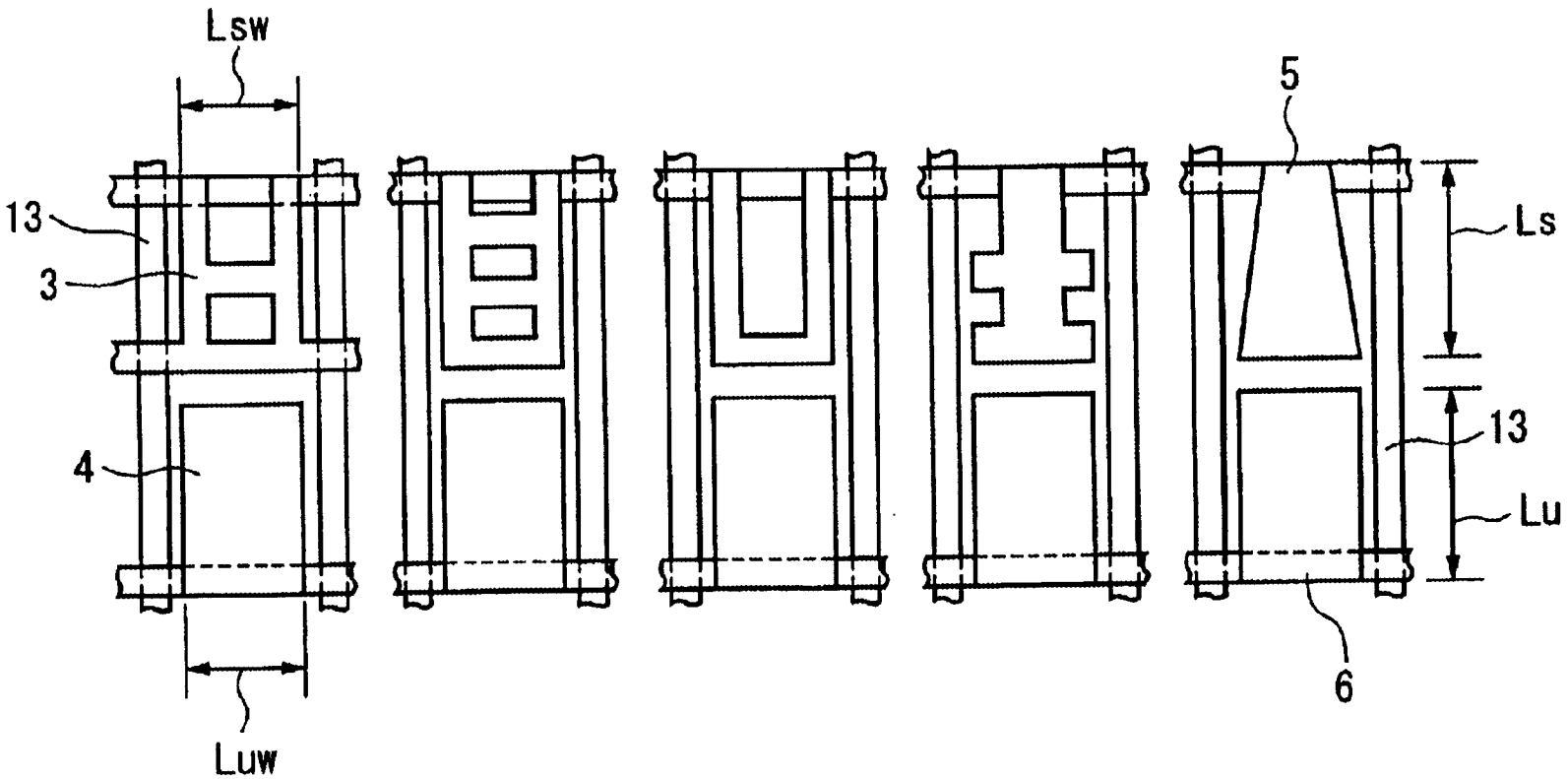
FIG. 18A to FIG. 18E are top views showing the structures of plasma display panels according to a seventh embodiment to an eleventh embodiment of the present invention respectively.

A ladder-shape electrode is provided in a center part of the scanning electrode in parallel with the sustaining electrode in the seventh embodiment as shown in FIG. 18A.

Multiple ladder-shape electrodes are provided in a center part of the scanning electrode in parallel with the sustaining electrode in the eighth embodiment as shown in FIG. 18B.

A part connecting a part of the scanning electrode close to the sustaining electrode and the bus electrode is provided only in a center part of the display cell in the horizontal direction in the ninth embodiment as shown in FIG. 18C.

An electrode in parallel with the sustaining electrode is added to the ninth embodiment in a center part in the tenth embodiment as shown in FIG. 18D.

A width of a part connecting a part of the scanning electrode close to the sustaining electrode and the bus electrode is wider as it gets close to the sustaining electrode in the eleventh embodiment as shown in FIG. 18E.

These embodiments provide effects of the second embodiment to the fifth embodiment in addition to the effect provided by the sixth embodiment simultaneously. Namely, effects such as the reduction of matrix discharge current during the writing discharge, the increase of transition characteristic to the surface discharge, and the increase of luminance in addition to the increase of luminous efficiency and the reduction of charge/discharge power of electrostatic capacity are provided.

The scanning electrodes 3 and the sustaining electrodes 4 arranged in parallel in the horizontal direction are connected with each other through the bus electrode in these embodiments where they are isolated in the individual display cells. Thus, it may be viewed as a scanning electrode driven by the scanning driver has the scanning electrode 3 and the bus electrode, and a sustaining electrode driven by sustaining driver has the sustaining electrode 4 and the bus electrode.

Though the embodiments where the sustaining electrode are shared by display cells in the horizontal direction, and have shapes of a stripe and a rectangle isolated in the individual cells are shown in these embodiments, the present invention is not limited to them. Because the luminance and the power consumption of a plasma display panel vary according to its application environment and the like, the sustaining electrode may have a partially removed shape considering prioritized characteristics in the application situation. Though the sustaining discharge current decreases to reduce the luminance slightly, the discharge power decreases to decrease the power consumption in this case. The horizontal lengths and the vertical lengths of scanning electrodes and the sustaining electrodes are set to equal to each other, and the area of sustaining electrode is set to wider than the area of scanning electrode to provide the same effect as in the embodiments described above.

What is claimed is:

1. A plasma display panel comprising:

a transparent substrate; and scanning electrodes and sustaining electrodes formed on said transparent substrate extending in a first direction, an area of said scanning electrode being smaller than an area of said sustaining electrode in each of display cells, and the widths of said scanning electrode and said sustaining electrode in a second direction crossing the first direction being substantially equal to each other.

2. The plasma display panel according to claim 1, wherein said scanning electrode comprises a ladder-shape electrode extending in the first direction provided in a center part thereof in the second direction.

3. The plasma display panel according to claim 1, wherein said scanning electrode includes a portion protruding in the first direction in a center part thereof in the second direction.

4. The plasma display panel according to claim 1, wherein a dimension of said scanning electrode in the first direction increases as it approaches said sustaining electrode.

5. The plasma display panel according to claim 1, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

6. The plasma display panel according to claim 2, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

7. The plasma display panel according to claim 3, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

8. The plasma display panel according to claim 4, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

9. The plasma display panel according to claim 5 wherein the maximum dimensions of said scanning electrode and said sustaining electrode are dimensions of parts that oppose to each other.

10. The plasma display panel according to claim 6 wherein the maximum dimensions of said scanning electrode and said sustaining electrode are dimensions of parts that oppose to each other.

11. The plasma display panel according to claim 7 wherein the maximum dimensions of said scanning electrode and said sustaining electrode are dimensions of parts that oppose to each other.

12. The plasma display panel according to claim 8 wherein the maximum dimensions of said scanning electrode and said sustaining electrode are dimensions of parts that oppose to each other.

13. A plasma display panel comprising:

a transparent substrate; and scanning electrodes and sustaining electrodes formed on said transparent substrate extending in a first direction, an area of said scanning electrode being smaller than an area of said sustaining electrode in each of display cells, and the widths of said scanning electrode and said sustaining electrode in a second direction crossing the first direction being substantially equal to each other, wherein said sustaining electrode is substantially rectangular in shape and said scanning electrode has at least two portions, one portion extending in said first direction and at least one other portion extending in said second direction.

14. The plasma display panel according to claim 13, wherein said scanning electrode comprises a ladder-shape electrode extending in the first direction provided in a center part thereof in the second direction.

15. The plasma display panel according to claim 13, wherein said scanning electrode includes a portion protruding in the first direction in a center part thereof in the second direction.

16. The plasma display panel according to claim 13, wherein a dimension of said scanning electrode in the first direction increases as it approaches said sustaining electrode.

17. The plasma display panel according to claim 13, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

18. The plasma display panel according to claim 14, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

19. The plasma display panel according to claim 15, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

20. The plasma display panel according to claim 16, wherein said scanning electrode and said sustaining electrode are isolated in each of said display cells, said scanning electrode and said sustaining electrode arranged in the first direction are commonly connected with a bus electrode, respectively, and the maximum dimension of said scanning electrode in the first direction is substantially equal to the maximum dimension of said sustaining electrode in the first direction.

21. The plasma display panel according to claim 17, wherein the maximum dimensions of said scanning electrode and said sustaining electrode are dimensions of parts that oppose to each other.

22. The plasma display panel according to claim 18, wherein the maximum dimensions of said scanning electrode and said sustaining electrode are dimensions of parts that oppose to each other.

23. The plasma display panel according to claim 19, wherein the maximum dimensions of said scanning electrode and said sustaining electrode are dimensions of parts that oppose to each other.

24. The plasma display panel according to claim 20, wherein the maximum dimensions of said scanning electrode and said sustaining electrode are dimensions of parts that oppose to each other.

* * * * *